US005116081A

United States Patent [19]

Mann, Jr.

[11] Patent Number: 5,116,081

[45] Date of Patent: May 26, 1992

[54] RING BINDER ADAPTOR FOR REMOVABLE COVERS

[76] Inventor: John C. Mann, Jr., 29 Tuthill Point Rd., East Moriches, N.Y. 11940

[21] Appl. No.: 728,878

[22] Filed: Jul. 12, 1991

[51] Int. Cl.[5] ..... B42D 3/00; B42D 3/06; B42F 13/00

[52] U.S. Cl. ..... 281/36; 281/37; 402/73; 402/75; 402/80 P

[58] Field of Search ..... 281/36, 37; 402/57, 402/60, 73, 75, 80 P

[56] References Cited

U.S. PATENT DOCUMENTS

| | | | |
|---|---|---|---|
| 433,337 | 7/1890 | Fitzgerald | 402/75 X |
| 1,437,329 | 11/1922 | Wilburger | 402/57 |
| 1,508,821 | 9/1924 | Schade | 281/36 X |
| 1,802,793 | 4/1931 | Trussell | 281/37 X |
| 1,972,048 | 10/1933 | Rennie | 281/37 |
| 2,583,403 | 1/1952 | Wiser | 281/37 X |
| 3,074,744 | 1/1963 | Pucci et al. | 281/37 |
| 3,159,411 | 12/1964 | McKowen | 281/36 X |
| 4,596,482 | 6/1986 | Salzer | 281/36 X |
| 4,934,738 | 6/1990 | Colonna | 402/73 X |

FOREIGN PATENT DOCUMENTS

| | | | |
|---|---|---|---|
| 2376756 | 9/1978 | France | 402/80 P |

*Primary Examiner*—Paul A. Bell
*Attorney, Agent, or Firm*—McAulay Fisher Nissen Goldberg & Kiel

[57] ABSTRACT

An adaptor for a ring separator is attached to a conventional ring separator mechanism and provides a means for attaching removable covers to form a binder. The adaptor has a plurality of slots on each side requiring a cover, with at least one slot on each side having an upwardly extending projection which is matable with a hole in a removable cover. The removable cover also has a notched edge with extending portions being receivable slots in the adaptor. When pressed into the slots, the projection engages the hole to hold the cover in place. Utilizing such an adaptor provides a simple efficient means of providing removable covers for a ring binder.

7 Claims, 2 Drawing Sheets

RING BINDER ADAPTOR FOR REMOVABLE COVERS

CROSS REFERENCE TO RELATED APPLICATION

This application is related to the applicant's copending application titled "Ring Binder Separator", attorney docket no. GK-MDT-299K, filed on even date herewith

TECHNICAL FIELD

This invention relates to ring binders and more particularly to an adaptor for a ring binder which provides means for adding separable covers to the ring binder.

BACKGROUND

There are various types of ring binders available with the most common employing three separable ring assemblies spaced at fixed locations on a metal backing member. Front and rear covers extend from a backing strip which is typically riveted to the backing member. The ring assemblies usually have complementary arcuate ring halves, having fixed ends anchored to the backing member. Typically, a spring assembly is included for biasing the opposing ring halves into engagement. The ring halves are separable into an open locked position when sheets are added to or removed from the binder. In some binders, the rings may be separated by pulling on the opposite ring halves while in others a pressure element, acting through the backing member and having handles disposed at one or both ends of the backing member may be provided to effect release.

In U.S. Pat. No. 3,074,744 to Pucci et al, a book has a back and a pair of separate hinges, which are strips with beaded edges. Two side covers are provided, each having a beaded edge with a channel extending its entire length. A slot is provided in the covers and a pair of slots provided in the back within which a hinge beaded edge is located to attach the covers to the back. This allows the covers to be removed if damaged due to cold weather by sliding in or out from the ends.

Removable covers have not been used commercially in ring binders due to the simplicity of the unitary back and covers. With the covers attached to the backing, simply riveting the back to the ring separator provides a completed binder. However, removable covers have the advantage of providing an easy way to change covers to match subject matter or to change them to a different ring separator mechanism. The means for accomplishing this described in Pucci has the disadvantage of requiring a multiplicity of parts to produce the binder. For example, as shown in FIG. 3 of Pucci, a ring separator is attached to the back, there are two separate hinges and then two separate covers which must be attached to produce the book. Also, there are no means to prevent the covers from sliding out of the beaded edge for example when griped or when placed on a shelf. Consequently, such a binder has not gained favor in the industry.

SUMMARY OF INVENTION

It is an object of the present invention to provide an adaptor usable with conventional ring separators to adapt them to accept removable covers.

It is another object to provide an adapter with few parts to enhance utilization and reduce costs.

It is another object to provide an adaptor with means for locking the covers in place.

It is a further object to provide an adaptor useable with slim line ring binder separators, with the adaptor being thin to maintain that feature.

These and other objects of the present invention are achieved by an adaptor for a ring separator having one or more separable rings attached to a backing member and having means for separating the rings, the adaptor comprising a mounting element, having a width corresponding to the width of the separator, and means for attaching the mounting element to the ring separator. The element also has a plurality of slots on each side, at least one slot on each side having an upwardly extending projection therein. A removable cover is provided which incorporates an integral hinge and has a notched edge complementary to the slotted element. The cover has at least one hole alignable with the projection for locking the cover in the element. The cover is slid into the adaptor until the projection mates with the hole thus locking the cover in place. Since a plurality of slots are used, the cover is not movable axially and is firmly retained within the adaptor.

Such an adaptor can be used with any ring separator and may be fastened to the separator by adhesives or rivets as is conventionally done. The cover slides into the adaptor from the side, not the end, and provides a snap fit, yet can be pulled out by overcoming the resistance encountered by the projection residing in the hole. The plurality of slots allows the adaptor to be thin yet provide high strength.

DETAILED DESCRIPTION OF THE INVENTION

Figure 1:
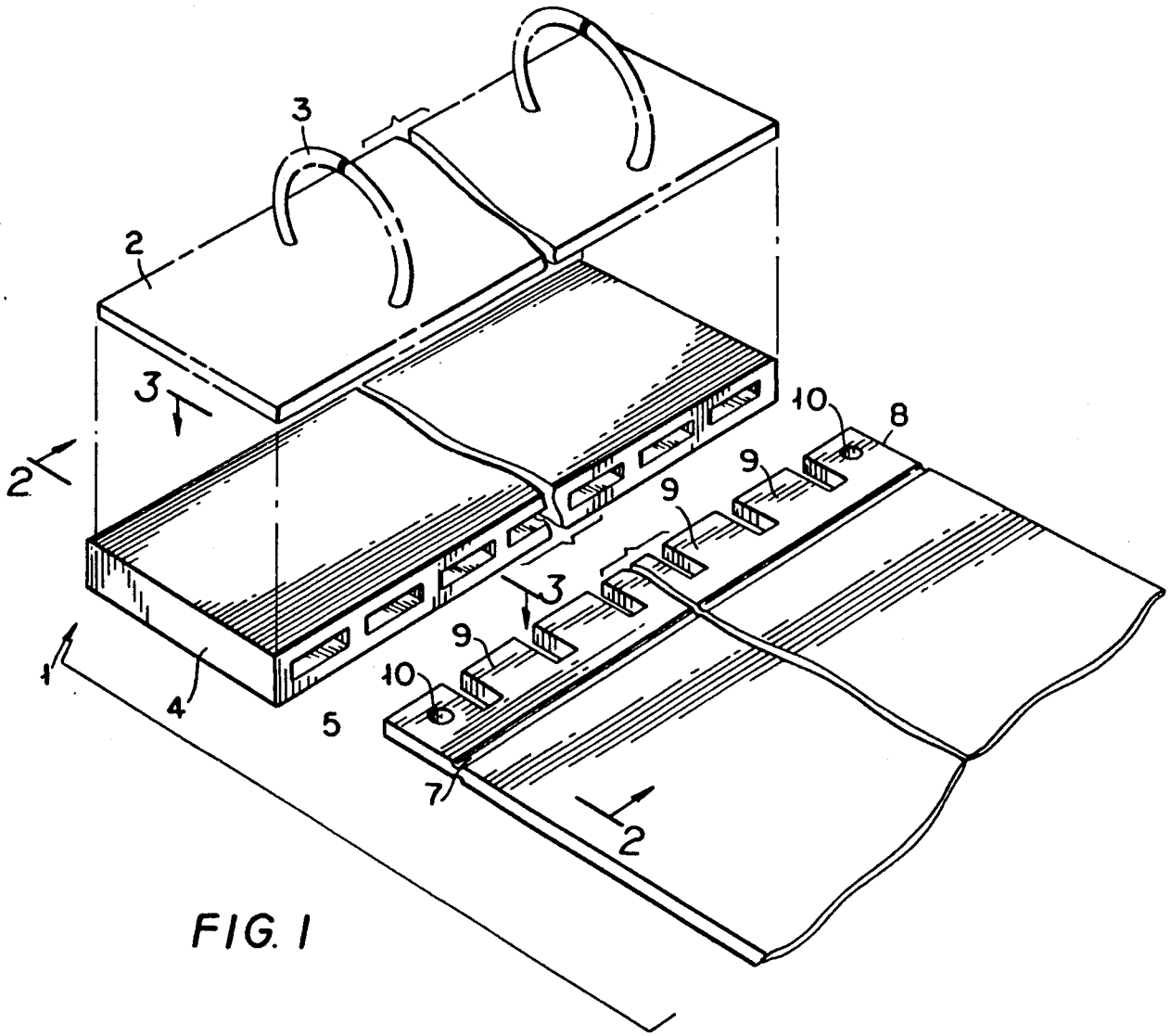
FIG. 1 is a exploded view of a ring binder separator mechanism and the adaptor of the present invention.

Referring to FIG. 1, a ring binder separator 1 has a backing member 2 with rings 3 engaged therewith. The rings are typically spring biased into engagement to hold a plurality of sheets of papers therebetween. While two rings are shown, any number of rings could be used. Additionally, any conventional ring binder separator assembly could be used with the present invention. In fact, it is a purpose of the invention to use the adaptor with conventional ring binder separators.

Referring still to FIG. 1, an adaptor 4 has a width to match the width of the binder and provides a back for the binder. The adaptor has a plurality of slots 5 which extend into the body of the adaptor. Each slot has a width approximating the width of the cover material. The adaptor is rectangular and is preferably thin, having a thickness of 2–3 times the thickness of the desired cover. The slots are located on the sides which accept covers.

A cover 6 has an integral hinge 7 which preferable is a living hinge or another type hinge. Adjacent to hinge 7 is a notched edged 8 which has portions 9 which are sized for reception in the slots 5 in the adaptor 4. The notched edge also has a pair of locating holes 10 at the ends thereof.

Figure 2:
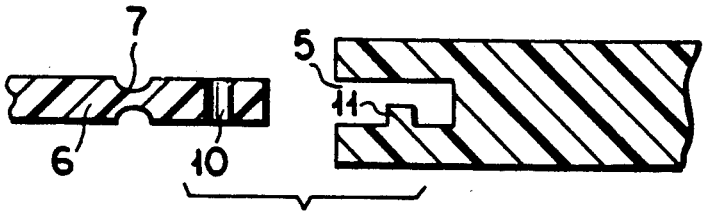
FIG. 2 is a cross sectional view taken along line 2—2 of FIG. 1.
Figure 3:
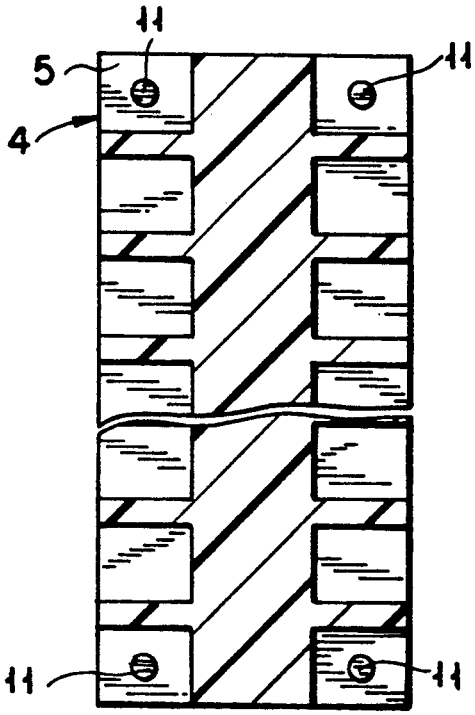
FIG. 3 is a cross sectional view taken along line 3—3 of FIG. 1.

Referring to FIG. 2, the slot 5 has a projection 11 entering partially into the slot. The projection 11 is matable with the hole 10 in the cover for locking the cover in place. FIG. 3 shows the depth of the slots in the adapter.

Preferably, the adaptor is produced of plastic and made by injection molding. For example, the adaptor may be made of polyvinyl chloride (PVC), ABS or nylon and be either unfilled or filled with a reinforcement material such as fiberglass. ABS is preferred as it is an economic material of good strength and flexibility. If made of plastic, the projection 11 can be somewhat resilient to allow locking the cover in the adaptor, with release performed by overcoming the resilient effect by pulling the cover from the projection. The adaptor can be made very thin since, using a slotted edge, structural strength is provided by the plastic material located between the slots which adds sufficient stiffness to allow the adaptor to be used as a backing member.

Figure 4:
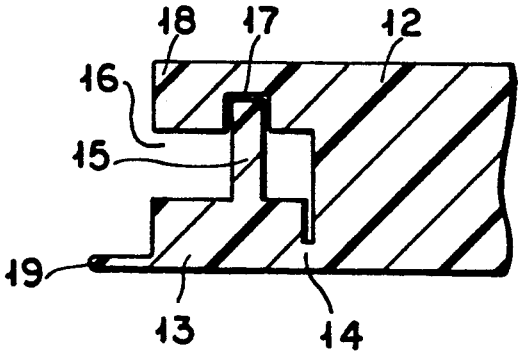
FIG. 4 is an alternative embodiment of the present invention.

In another embodiment, shown in FIG. 4, an adaptor 12 has a lower corner portion 13 connected by a hinge 14 to the adaptor. A projection 15, which is of sufficient length to extend through the space 16 and into a receptacle 17 in an upper wall 18 of the adaptor, preferably with an interference fit. Thus, the corner portion is manually released from the upper wall prior to receipt of the cover within the slots. The corner portion is pushed into place, forcing the projection through the hole and into the receptacle thereby firmly locking the cover in place. To remove the cover, the corner portion is pulled free and the cover removed. A lip 19 is added to assist in gripping the portion 13.

Utilizing an adaptor for use with conventional ring binder separators provided a means to using releasable covers on virtually any type of binder. The adaptor is thin and of unitary construction minimizing complexity and cost. By utilizing a notched edge cover and a plurality of slots in the adaptor, firm locking of the cover is attained and the potential for accidental release of the cover or shifting is eliminated. Consequently, the above invention makes practical the incorporation of releasable covers on conventional binders.

While preferred embodiments of the present invention have been shown and described, it will be understood by those skilled in the art the various changes and modifications could be made without varying from the scope of the invention.

I claim:

1. An adaptor for a ring binder having a separator mechanism with one or more separable rings attached to a backing member and having means for separating the rings, the adaptor comprising a mounting element, having a width corresponding to the width of the binder, means for attaching the mounting member to the backing member, the mounting element having a plurality of slots on a side thereof, at least one slot having a upwardly extending projection entering into the slot, and, a removable cover having an integral hinge and a notched edged, the edge having extending portions which are receivable the slots in the mounting element, and having at least one hole alignable with the projection for locking the cover in the element.

2. The adaptor of claim wherein the mounting member further comprises hinged corner portions, each hinged corner portion having an upwardly extending projection of a length sufficient to pass through a slot and into a receptacle in an upper wall of the mounting element.

3. The adaptor of claim 1 wherein the projection extends partially into the slot.

4. The adaptor of claim 1 wherein the mounting member is composed of a plastic material from the group consisting of polyvinyl chloride, ABS, and nylon.

5. The adaptor of claim 4 wherein the adaptor is formed by injunction molding.

6. The adaptor of claim 1 wherein the element is rectangular.

7. The adaptor of claim 6 wherein the adaptor has four projections, each projection disposed in a corner thereof.

* * * * *